US010076146B2

(12) United States Patent
Kennedy

(10) Patent No.: US 10,076,146 B2
(45) Date of Patent: Sep. 18, 2018

(54) BELT WITH FIVE DEADLY BLADES FOR SELF DEFENSE

(71) Applicant: Dexter Vaughn Kennedy, Columbia, SC (US)

(72) Inventor: Dexter Vaughn Kennedy, Columbia, SC (US)

( * ) Notice: Subject to any disclaimer, the term of this patent is extended or adjusted under 35 U.S.C. 154(b) by 252 days.

(21) Appl. No.: 14/991,951

(22) Filed: Jan. 9, 2016

(65) Prior Publication Data

US 2017/0196287 A1 Jul. 13, 2017

(51) Int. Cl.

| | |
|---|---|
| ***A41F 9/00*** | (2006.01) |
| ***A44B 11/00*** | (2006.01) |
| ***F41B 13/00*** | (2006.01) |
| *B26B 11/00* | (2006.01) |
| *B26B 29/00* | (2006.01) |

(52) U.S. Cl.

CPC ..... *A41F 9/002* (2013.01); *A44B 11/005* (2013.01); *F41B 13/00* (2013.01); *B26B 11/00* (2013.01); *B26B 29/00* (2013.01)

(58) Field of Classification Search

CPC ..... A41F 9/002; A41F 9/00; A44B 11/005; A44C 5/00; B26B 11/00; B26B 29/00

See application file for complete search history.

(56) References Cited

U.S. PATENT DOCUMENTS

| | | | | |
|---|---|---|---|---|
| 3,823,421 | A * | 7/1974 | Collins | A41F 9/002 2/321 |
| 4,078,272 | A * | 3/1978 | Mahon, III | B26B 1/02 24/186 |
| 4,100,655 | A * | 7/1978 | Langley | A41F 9/002 2/322 |
| 4,313,230 | A * | 2/1982 | Chovaniec | A41F 9/002 2/322 |
| 5,217,150 | A * | 6/1993 | Chen | A44B 11/005 224/163 |
| 6,067,661 | A * | 5/2000 | Bates | A41F 9/002 2/250 |
| 6,363,614 | B1 * | 4/2002 | Umstead | B23D 51/01 30/144 |
| 7,856,672 | B1 * | 12/2010 | Koehler | A41F 9/002 2/312 |
| 9,084,455 | B2 * | 7/2015 | Millan | B26B 9/00 |
| 2015/0208795 | A1 * | 7/2015 | Vanheteren | A45F 5/021 224/232 |
| 2016/0286910 | A1 * | 10/2016 | Fisher | B26B 27/007 |
| 2017/0340070 | A1 * | 11/2017 | Bloch | A44C 5/003 |
| 2017/0360159 | A1 * | 12/2017 | Anderson | A44B 11/005 |

FOREIGN PATENT DOCUMENTS

| | | | | |
|---|---|---|---|---|
| DE | 29908076 U1 * | 4/2000 | | A44B 11/005 |

* cited by examiner

*Primary Examiner* — Christopher R Harmon

(57) ABSTRACT

A belt with five different shapes of blades, this belt can be used as a weapon in self-defense. The belt has an extended reach of about 4-6 feet depending on the user's belt size and arm length to strike an adversary, the belt includes a buckle that works as a sheath to conceal any one of the five deadly blades that have been designed to be used as a weapon to strike, cut or spear ones attacker, the belt can be worn with a suit or casual dress, the belt is made of leather, rubber and or elastic and stainless steel.

6 Claims, 5 Drawing Sheets

BELT WITH FIVE DEADLY BLADES FOR SELF DEFENSE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Field of the Invention

The present invention relates to the belts and self defense tools.

Description of the Related Art

The world is a dangerous place to live, having a concealed weapon would make anyone feel safer because he will be ready at any time to use it as a self defense tool without forget it. The present invention is a self defense tool as a solution to crime. Any time a person wants to make a victim, this tool will change the outcome. This self defense tool maybe the best solution for anyone that may feel threatened by a possible criminal this tool will change the odds in their favor. This invention is a belt that can be worn with trousers, a skirt, suit or any type of clothing that requires a belt, this belt includes a set of deadly blades that can be used as a self defense weapon should someone want to abuse the wearer or owner, there are five belt designs each having its own shape, the belt also includes a buckle that is used to conceal the blade that is selected to be worn with the belt.

BRIEF SUMMARY OF THE INVENTION

In one aspect the present invention is a belt for self defense where we can wear it as any belt with any type of clothes, there are five shapes of deadly blades that come with this belt.

In another aspect there is a buckle to conceal any one of the belt blades so as not to cause wounds to someone wear it.

DESCRIPTION OF THE DRAWINGS

For a more complete understanding of the present invention, reference is now made to the following descriptions.

REFERENCE NUMERALS IN THE DRAWINGS

For a more complete understanding of the present invention parts, reference is now made to the following descriptions:

1—The main part of the belt.
2—The blades.
2A—The first blade shape.
2B—The second blade shape.
2C—The third blade shape.
2D—The fourth blade shape.
2E—The fifth blade shape.
3—The buckle.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Figure 1:
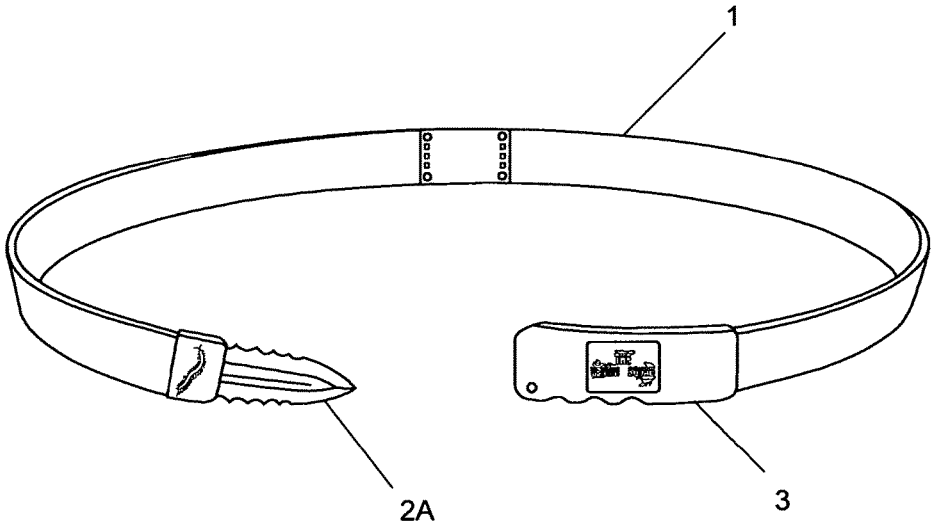
FIG. 1 is a perspective view of the belt with the first blade shape (centipede).
Figure 2:
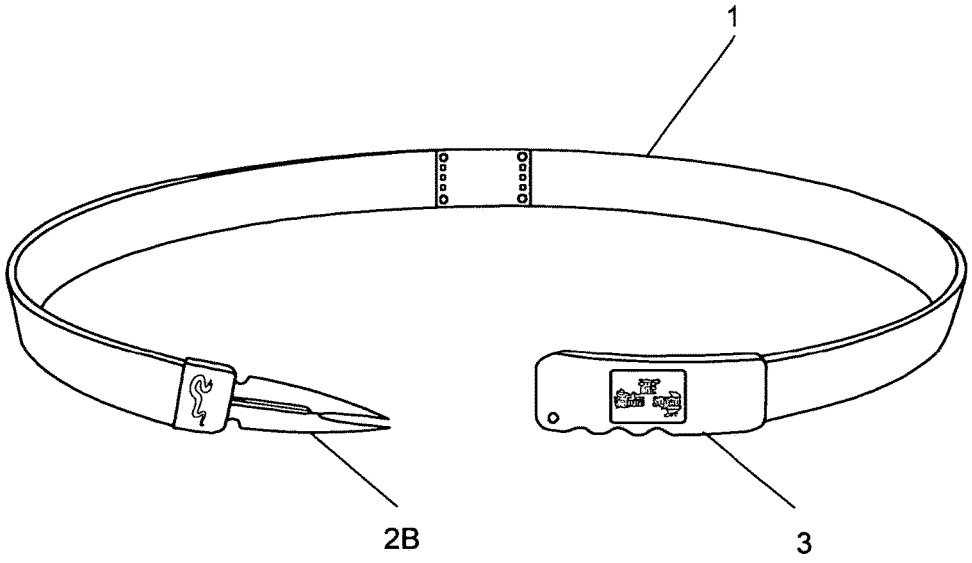
FIG. 2 is a perspective view of the belt with the second blade shape (snake).
Figure 3:
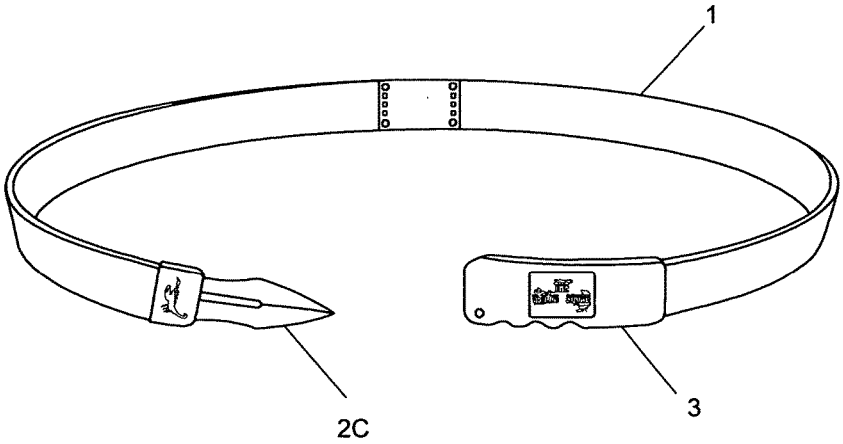
FIG. 3 is a perspective view of the belt with the third blade shape (scorpion).
Figure 4:
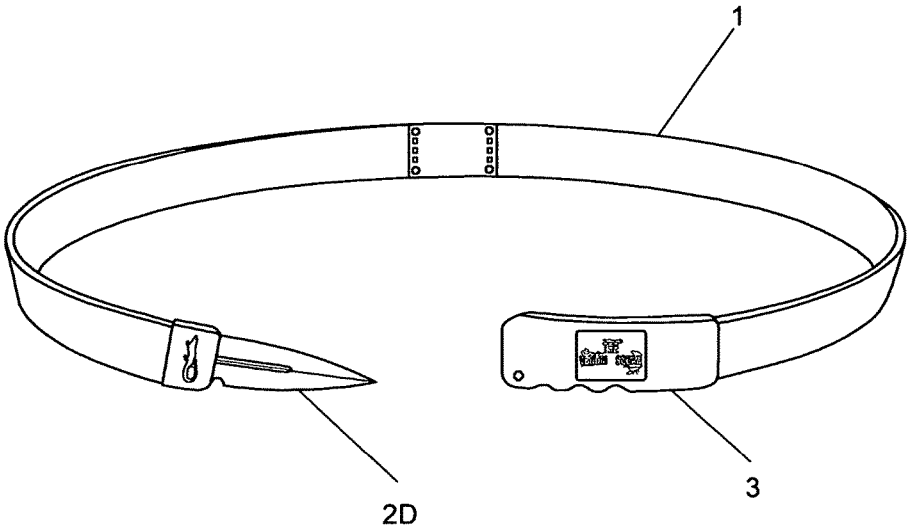
FIG. 4 is a perspective view of the belt with the fourth blade shape (lizard).
Figure 5:
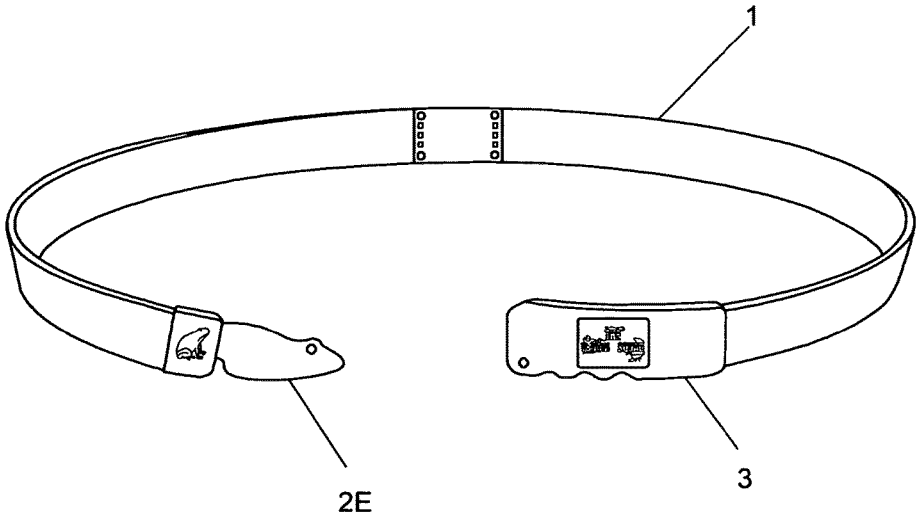
FIG. 5 is a perspective view of the belt with the fifth blade shape (toad).

Referring to FIG. 1, FIG. 2, FIG. 3, FIG. 4 and FIG. 5 the present invention is a belt with five different shapes of blades, this belt can be used as a weapon or tool in self-defense. The belt has an extended reach of about 4-6 feet depending on the user's belt size and arm length to strike an adversary. This belt can be worn with trousers, a skirt, suit or any type of clothing, this belt includes a deadly blade that can be used for self defense when someone wants to abuse us or want to steal anything from us, there are 5 shapes of these blades and there is a buckle to conceal the blades so the belt does not cause any wounds to the person wearing it.

The belt consists of three parts, the first part is the main part 1, the second part is the blade 2 and the third part is a buckle 3. The main part 1 made of leather, rubber and or elastic. As for the blades, there are five deadly blades 2 designed to be used to strike, cut or spear ones attacker, there are five shapes of blades 2, each one of the five has a specific shape depending on on its strength to strike, the first blade shape 2A is in the form of centipede, this blade form is serrated from the two sides and sharp from the front, the second blade shape 2B is in the form of the snake's forked tongue and sharpened on each of the tongue sides, the third blade shape 2C is in the form of a scorpion, this blade is sharp from the front and sides as a spear, the fourth blade shape 2D is in the form of lizard, this blade shape is sharp from the front and below, the fifth blade shape 2E is in the form of toad and weighted for striking and the only blade that does not have sharp edges so the momentum can be used to knock out a person or bruise, As for the buckle, there is a buckle 3 which works as a sheath to conceal any one of the. five deadly blades 2 so the belt does not cause any wounds for someone to wear it.

The invention claimed is:

1. A self defense belt comprising a main belt portion with opposing ends; a buckle attached to one end of said belt portion; a blade attached to a distal end of said main belt portion opposite said buckle; wherein said buckle acts as a sheath for said blade.

2. The self defense belt of claim 1, wherein said blade has two serrated lateral edges meeting at a point configured as a centipede.

3. The self defense belt of claim 1, wherein said blade is forked, sharpened on each side, configured as the tongue of a snake.

4. The self defense belt of claim 1, wherein said blade is spear shaped, sharp from the front and sides configured as a scorpion.

5. The self defense belt of claim 1, wherein said blade is sharp from the front and below configured as a lizard.

6. The self defense belt of claim 1, wherein said blade is blunt and weighted configured as a toad.

* * * * *